US009334030B2

(12) United States Patent
Lee et al.

(10) Patent No.: US 9,334,030 B2
(45) Date of Patent: May 10, 2016

(54) METHOD AND SYSTEM FOR MANAGING TRAFFIC CONSIDERING GPS JAMMING

(71) Applicant: Electronics and Telecommunications Research Institute, Daejeon (KR)

(72) Inventors: Byung Gil Lee, Daejeon (KR); Byung Doo Kim, Daejeon (KR); Do Hyeung Kim, Daejeon (KR); Joong Yong Choi, Uijeongbu-si (KR); Hyun Sook Cho, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 357 days.

(21) Appl. No.: 13/940,385

(22) Filed: Jul. 12, 2013

(65) Prior Publication Data

US 2014/0111368 A1 Apr. 24, 2014

(30) Foreign Application Priority Data

Oct. 22, 2012 (KR) ..... 10-2012-0117529
Feb. 27, 2013 (KR) ..... 10-2013-0020929

(51) Int. Cl.
*B63B 49/00* (2006.01)
*G08G 3/02* (2006.01)

(52) U.S. Cl.
CPC . *B63B 49/00* (2013.01); *G08G 3/02* (2013.01)

(58) Field of Classification Search
CPC ..... B63B 49/00; G08G 3/02
USPC ..... 342/41
See application file for complete search history.

(56) References Cited

U.S. PATENT DOCUMENTS

2009/0061759 A1* 3/2009 Stoddard ..... H04K 3/41 455/1

FOREIGN PATENT DOCUMENTS

KR 1999-0083728 A 12/1999

OTHER PUBLICATIONS

Un-Seob Jeong et al., A Time-Sharing TX/RX Control Technique for the Rejection of Feedback Noise Jamming Interference, The Korean Institute of Communications and Information Sciences (KICS) journal, Dec. 2005, vol. 30, No. 12C.

* cited by examiner

*Primary Examiner* — Timothy A Brainard
(74) *Attorney, Agent, or Firm* — NSIP Law

(57) ABSTRACT

The traffic control method according to the present invention includes obtaining radar information on a target from at least one radar; obtaining AIS information of the target from an AIS (automatic identification system) of the target; detecting GPS jamming; and fusing the radar information and the AIS information. The fusing selectively fuses the AIS information depending on whether the GPS jamming occurs in the position of the target as a result of the detection.

16 Claims, 4 Drawing Sheets

METHOD AND SYSTEM FOR MANAGING TRAFFIC CONSIDERING GPS JAMMING

CROSS-REFERENCE TO RELATED APPLICATIONS

This application claims priority to and the benefit of Korean Patent Application No. 10-2012-0117529 filed on Oct. 22, 2012 and 10-2013-0020929 filed on Feb. 27, 2013 in the Korean Intellectual Property Office, the entire contents of which are incorporated herein by reference.

TECHNICAL FIELD

The present invention relates to a method and a system for managing traffic of a navigation body such as a ship or an aircraft, and more specifically, to a method and a system for managing traffic in order to prevent confusion of traffic control and a risk of an accident when a GPS is jammed.

Hereinafter, for the convenience of understanding the present invention, in this description, a ship will be used as an example of a navigation body. However, it is understood by a skilled person in the art that the present invention may be applied to other navigation body such as an aircraft other than the ship.

BACKGROUND ART

When ships collide on the sea, mostly, it is considered that the collision occurs due to carelessness of a ship operator. However, the operator who operates the ship cannot focus on sailing at every moment and it is difficult to check and predict all circumstances which may occur while sailing.

That is, rather than by the ships that determine whether there is collision and measure against the collision in order to prevent the collision between sailing ships, it is more efficient that a ground control center checks the movement of all ships and predicts a dangerous situation and then if the possibility of a collision is high, notifies the corresponding ship.

Therefore, in all main domestic and foreign ports, a vessel traffic control system is provided and operated and a control system which prevents the collisions of the ships while the ship is sailing is provided.

In the related art, a controller intensively watches a control screen on which a position of the ship is displayed and checks a distance between the ships based on his experience to predict the possibility of a collision between ships. If the controller determines that the collision possibility is high, the controller controls a sailing route of the corresponding ships to control the traffic.

In the ship, the controller uses a radar device mounted in the ship to identify nearby ships and sails the ship while referring to the identified ship.

In the meantime, in accordance with the development of marine radio communication technology, an automatic identification system (AIS) is used in the ship to send ship information including its own identification information (for example, a name of the ship) to the control center so that the control center can clearly identify a ship located in any specific position on the sea. Generally, on the control screen of the control center, a current position of a ship or an aircraft is shown on a map together with the brief name of the ship or the aircraft thereby.

That is, the AIS provided in the ship transmits MMSI (maritime mobile service identity) information, position information (for example, latitude and longitude coordinates), and dynamic information through which the ship can be automatically identified to the control center to identify the ship and easily figure out the location to increase the control efficiency.

Examples of various information included in the AIS information will be represented in the following Table 1.

TABLE 1

| Classification | Content of information | Remarks |
|---|---|---|
| Static information (ship data) | ship name, IMO number, call sign<br>type of ship<br>length, width, and breadth of ship<br>position of antenna (stern/bow/left and right of center line) | If there is any change, frequently input changed matter |
| Dynamic information | position of ship, course over the ground, ground speed, and heading direction of ship<br>sailing status (sailing or anchored)<br>rate of turn (optional)<br>tilted angle (optional) | Automatically input in accordance with sailing status of the ship (manual input is also allowed)) |
| Sailing information | draft of ship<br>dangerous cargo<br>destination and scheduled arrival time<br>route plan (optional) | Periodically and manually input before and during the sailing |
| Text communication | Important sailing or weather information is included | |

A vessel traffic control system figures out the location and speed of the ship from the AIS information transmitted from the ship and receives the result sensed by the radar which is a heterogeneous sensor at a predetermined period in order to understand the position in real time and uses them.

Basically, a target is tracked using the radar such that a plurality of unspecified object information received by a radar transceiver is analyzed to find out a movement characteristic of the corresponding target and continuously estimate the subsequent movement situation of the target therefrom. The tracking through the radar includes a tracking error and a mathematical filter which may minimize the error is used. The tracking is performed in real time through a dynamic filtering technique in which the tracking filter repeatedly estimates and updates the track. A Kalman filter is a representative filter thereof.

For continuous detection in the target tracking process, it is required to select an exact target among several objects. That is, the target is tracked in a situation where a clutter or a noise is present so that a data association method which can exactly select a real target object among sensor measured values from an uncertain source other than the object target which is currently being tracked is required for exact tracking. After associating the data, a track which is continuously connected to each of the target is generated and several tracks may be present depending on the number of targets. Typically, such track information is received from multiple radars rather than a single radar, the tracks generated by the multiple radars are fused and repeated tracks are removed. In this case, in order to increase the precision for the position, a fusion filter is used.

The information fused from the several radars is asynchronously fused with the latitude and longitudinal coordinates received from the AIS rather than the radar, again. The vessel traffic control system fuses the radar information and the AIS information to determine a final position of the target and display the determined final position on the screen so that the controller identifies the position or the speed of the ship and give a control instruction.

In the meantime, the AIS of the ship estimates its own position based on a signal received from a GPS (global positioning system), for example, a DGNSS (differential global navigation satellite system). Accordingly, if the GPS signal is jammed, a position information error occurs, which causes confusion for providing command control. The GPS signal has a weak signal strength so that the GPS signal is vulnerable to window jamming and can be easily jammed.

However, in the currently used vessel traffic control system, such a GPS jamming is not considered. That is, if the GPS jamming occurs, the ship transmits AIS information including erroneous position information and the erroneous AIS information is fused with the radar information so that an error occurs in the position which is displayed on the control system.

Even when the vessel traffic control system recognizes the GPS jamming, it is difficult to identify whether the AIS information or the fused information has an error so that incorrect control may be provided.

SUMMARY OF THE INVENTION

The present invention has been made in an effort to provide a method and a system for managing traffic which detect the GPS gamming in real time when the GPS jamming occurs to safely perform the control without causing the confusion to a control system and a controller.

The present invention provides a method and a system for managing traffic which filter AIS information which includes an error due to the GPS jamming during the information fusion process to more accurately figure out the position of a control object.

A traffic control method according to an exemplary embodiment of the present invention may include obtaining radar information on a target from at least one radar, obtaining AIS information of the target from an AIS (automatic identification system) of the target; detecting GPS jamming; and fusing the radar information and the AIS information. The fusing includes selectively fusing the AIS information depending on whether the GPS jamming occurs in the position of the target as a result of the detection.

The AIS information may include position information of the target.

The fusing may compare the already known position of the target with a region where the GPS jamming occurs to selectively fuse the AIS information.

The fusing may compare the already known position of the target with a region where the GPS jamming occurs and compare the AIS information with previously obtained AIS information to selectively fuse the AIS information.

The fusing may compare the already known position of the target with a region where the GPS jamming occurs and compare the AIS information with the radar information to selectively fuse the AIS information.

If the GPS jamming occurs in the position of the target as a result of the detection, in the fusing, the AIS information may not be fused.

The traffic control method may further include displaying that the AIS information is not fused if the AIS information is not fused.

The traffic control method may further include notifying the target of the GPS jamming if the GPS jamming occurs in the position of the target.

A traffic control system according to another exemplary embodiment of the present invention may include a GPS jamming detection device which detects GPS jamming, and an information fusing device which obtains radar information on a target from at least one radar, obtains AIS information of the target from an AIS (automatic identification system) of the target, and fuses the radar information and the AIS information. The information using device selectively fuses the AIS information depending on whether the GPS jamming occurs in the position of the target as a result of the detection.

The information fusing device may compare the already known position of the target with a region where the GPS jamming occurs to selectively fuse the AIS information.

The information fusing device may compare the already known position of the target with a region where the GPS jamming occurs and compare the AIS information with previously obtained AIS information to selectively fuse the AIS information.

The information fusing device may compare the already known position of the target with a region where the GPS jamming occurs and compare the AIS information with the radar information to selectively fuse the AIS information.

If the GPS jamming occurs in the position of the target as a result of the detection, the information fusing device may not fuse the AIS information.

If the AIS information is not fused, the information fusing device may notify that the AIS information is not fused to a control display device which displays a traffic control condition.

When the GPS jamming occurs in the position of the target, the information fusing device may notify the target of the GPS jamming.

According to the present invention, if the GPS jamming occurs, the GPS jamming is detected in real time, so that the control may be safely performed without giving confusion to a control system and a controller.

According to the present invention, the AIS information in which an error occurs due to the GPS jamming is filtered in the information fusing process so that the position of an object to be controlled is more accurately figured out.

The foregoing summary is illustrative only and is not intended to be in any way limiting. In addition to the illustrative aspects, embodiments, and features described above, further aspects, embodiments, and features will become apparent by reference to the drawings and the following detailed description.

Figure 1:
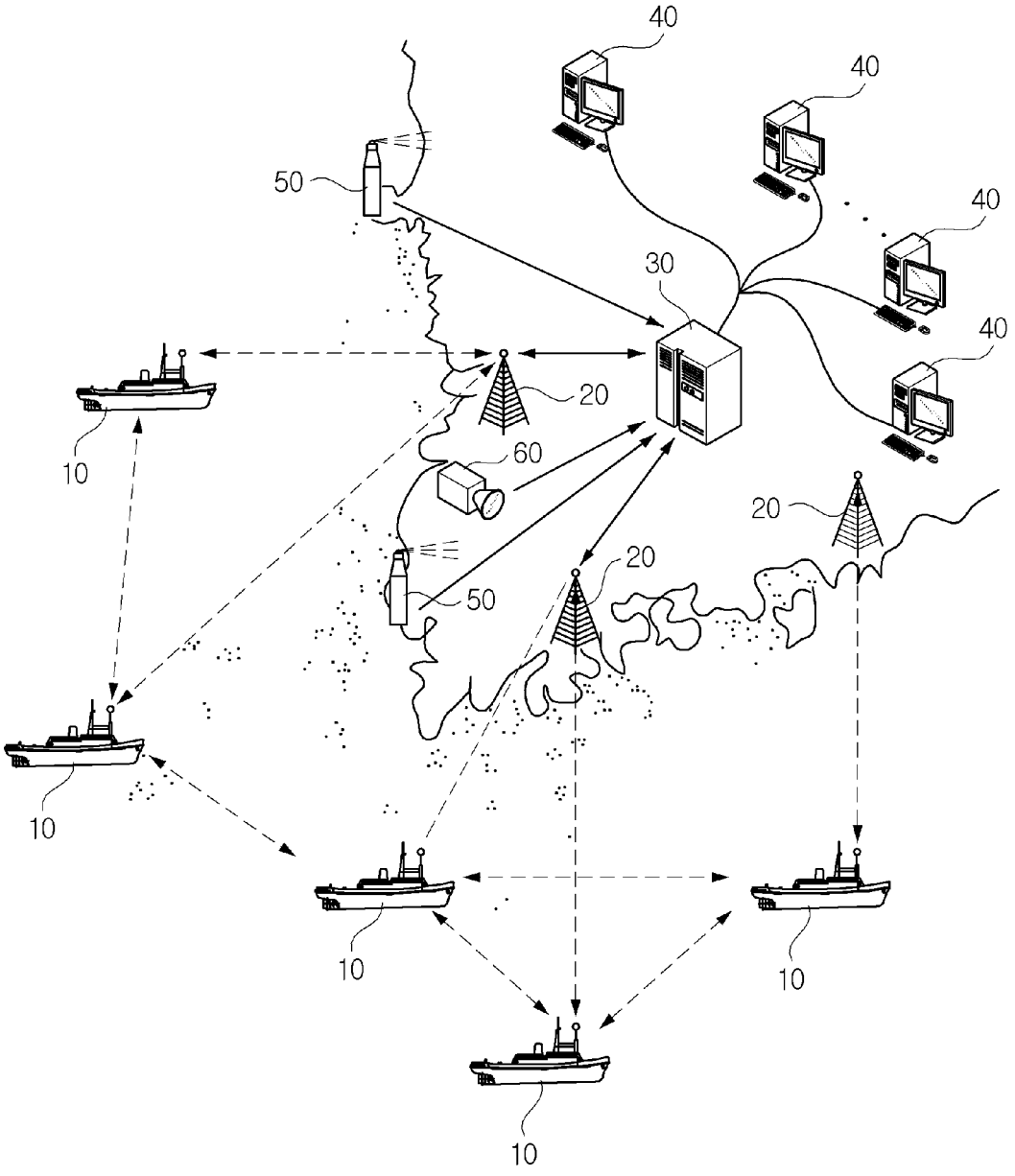
FIG. 1 is a view illustrating an example of a vessel traffic control network which may be applied to traffic control method and system according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, exemplary embodiments of the present invention will be described in detail with reference to the drawings. Substantially same components in the following description and the accompanying drawings may be denoted by the same reference numerals and redundant description will be omitted. In the description of the present invention, if it is considered that specific description of related known function or configuration may unnecessarily cloud the gist of the present invention, the detailed description thereof will be omitted.

FIG. 1 is a view illustrating an example of a vessel traffic control network which may be applied to traffic control method and system according to an exemplary embodiment of the present invention.

Referring to FIG. 1, an automatic identification system (AIS) which is implemented in a ship 10 transmits AIS information including a current position, a course, a speed, and a condition of the ship which are measured by a GPS and other information to a control center 30 through an AIS base station 20 on the ground. A radar 50 transmits radar information on a detected target to the control center 30 and a CCTV 60 captures an image on the sea and transmits captured image information to the control center 30. In the control center 30, the radar information and the AIS information are fused to generate fused information and the fused information is transmitted to a control display device 40 which is connected to the control center 30 through a network (for example, an Internet network). The control display device 40 displays a traffic control condition based on the information received from the control center 30 and a controller monitors the displayed traffic control condition to perform the control.

Figure 2:
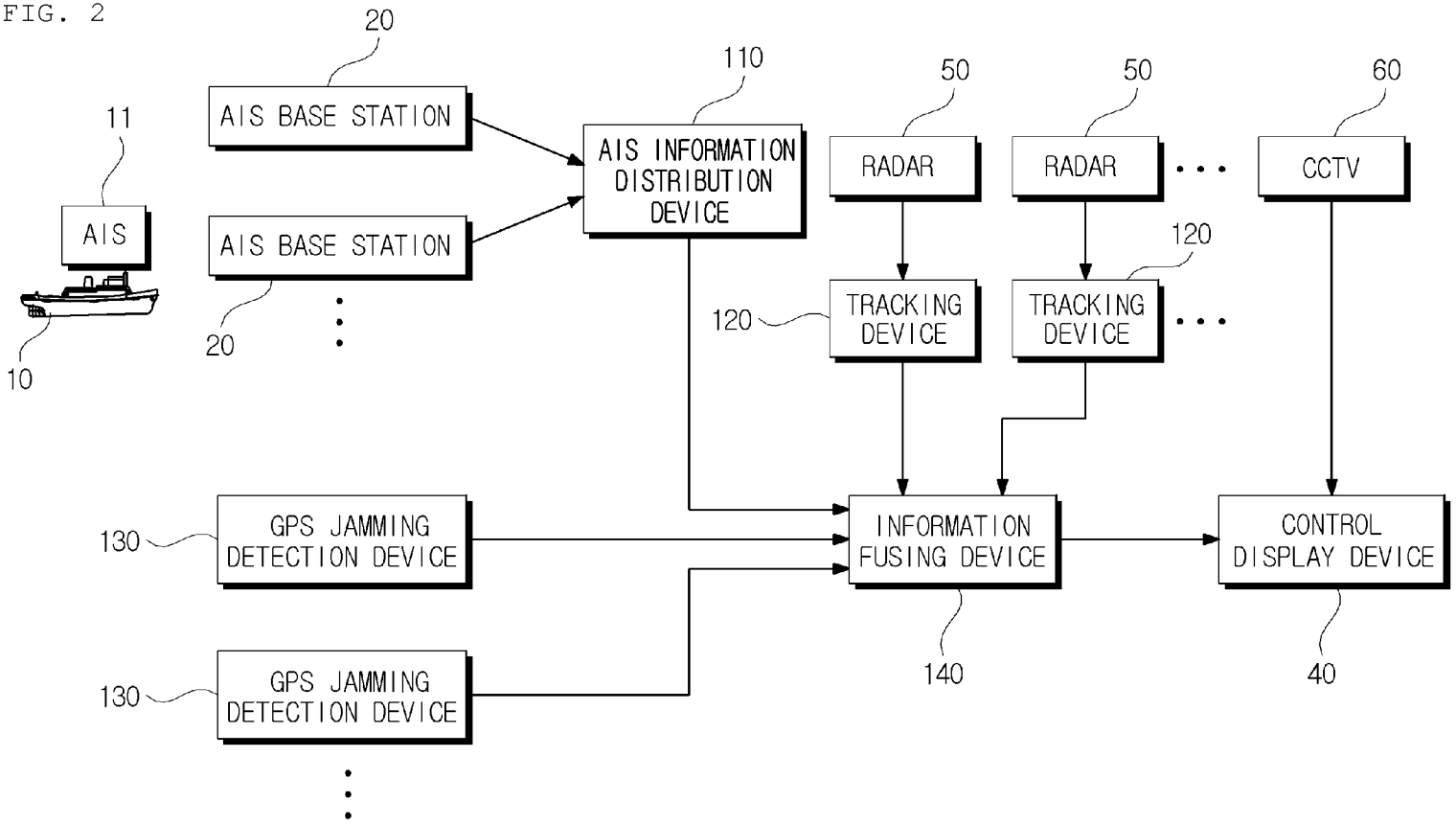
FIG. 2 is a block diagram illustrating the traffic control system according to an exemplary embodiment of the present invention.

FIG. 2 is a block diagram illustrating the traffic control system according to an exemplary embodiment of the present invention. Referring to FIG. 2, the traffic control system according to the exemplary embodiment includes AIS base stations 20, an AIS information distribution device 110, radars 50, the CCTV 60, tracking devices 120, GPS jamming detection devices 130, an information fusing device 40, and the control display device 40.

The AIS 11 which is implemented in the ship 10 transmits AIS information including a current position, a course, a speed, and a condition of the ship and other information to the AIS base stations 20.

The AIS base station 20 transmits the AIS information received from the ship 10 to the AIS information distribution device 110.

The AIS information distribution device 110 classifies the AIS information collected from several AIS base stations and transmits the AIS information to the information fusing device 140 which requests the AIS information.

The radar 50 detects the ship and provides radar information on the detected ship to the tracking device 120. The tracking device 120 removes a noise from the provided radar information and applies a tracking filter and a tracking algorithm to the radar information to generate track information of the ship. The track information generated in the tracking device 120 is transmitted to the information fusing device 140.

The CCTV 60 captures an image on the sea and transmits captured image information to the control display device 40 through the control center.

The GPS jamming detection device 130 detects the GPS jamming in the corresponding region and transmits GPS jamming information including whether the GPS jamming occurs, a position where the jamming occurs, and a region in which the jamming occurs to the information fusing device 140. The GPS jamming detection device 130 may be installed all over the ground or the sea and further installed in the radar or AIS base station or the ship.

The information fusing device 140 is provided in the above-mentioned control center 30. The information fusing device 140 fuses various collected information using a predetermined information fusing method. That is, the information fusing device 140 obtains radar information (specifically, track information) from the radar 50 and the tracking device 120, obtains the AIS information from the AIS 11, and fuses the radar information and the AIS information to calculate the current position and the speed of the ship. The calculated current position and speed information of the ship is transmitted to the control display device 40 and the control display device 40 displays the current position and speed information on a screen so as to allow the controller to check the information. The control display device 40 also displays the image information provided from the CCTV 60.

In the exemplary embodiment, the information fusing device 140 selectively fuses the AIS information in accordance with the GPS jamming information provided from the GPS jamming detection device 130. For example, if the information fusing device 140 identifies that the GPS jamming occurs in a position of an arbitrary ship through the GPS jamming information, the information fusing device 140 fuses only the radar information without fusing the AIS information with respect to the corresponding ship to calculate the position and the speed.

More specifically, the information fusing device 140 compares a position of the ship which is most recently found with a region where the GPS jamming occurs. If the position of the ship is included in the region or within a predetermined distance from the region, the information fusing device 140 fuses the collected information without including the AIS information.

The information fusing device 140 verifies the obtained AIS information together with the result of the comparison of the position of the ship with the region where the GPS jamming occurs to selectively fuse the AIS information based on the result of the verification. That is, if the GPS jamming occurs in the region, it is determined whether an error substantially occurs in the AIS information. If the AIS information has a substantial error, the AIS information is not fused.

For example, the information fusing device 140 selectively fuses the AIS information in accordance with the result of the comparison of the currently obtained AIS information with previously obtained AIS information. Specifically, if the position of the ship is included in the GPS jamming region or within a predetermined distance from the GPS jamming region, and a difference between the current position information of the AIS and the previous position information of the AIS is outside a predetermined range, the information fusing device 140 determines that the AIS information has an error and does not fuse the AIS information.

As another example, the information fusing device 140 may selectively fuse the AIS information in accordance with the result of the comparison of the position information obtained from the AIS with the position information obtained from the radar. Specifically, if the position of the ship is included in the GPS jamming region or within a predetermined distance from the GPS jamming region, and a difference between the current position information of the AIS and the position information obtained from the radar is outside a predetermined range, the information fusing device 140 determines that the AIS information has an error and does not fuse the AIS information.

The information fusing device 140 combines the result of the comparison of the currently obtained AIS information and the previously obtained AIS information and the result of the comparison of the position information obtained from the AIS and the position information obtained from the radar and then selectively fuses the AIS information.

In the exemplary embodiment of the present invention, if the information fusing device 140 is notified of occurrence of the GPS jamming from the GPS jamming detection device 130, the information fusing device 140 may provide the GPS jamming information to the control display device 40. If so, the control display device 40 displays the occurrence of the GPS jamming to allow the controller to check the occurrence of the GPS jamming. The control display device 40 may display the region where the GPS jamming occurs.

If the information fusing device 140 is notified of occurrence of the GPS jamming from the GPS jamming detection device 130, the information fusing device 140 notifies the ships which are included in the GPS jamming region or located within a predetermined distance from the GPS jamming region of the occurrence of the GPS jamming in the corresponding position. If the GPS jamming disappears as a result of the detection of the GPS jamming detection device 130, the information fusing device 140 notifies the ships thereof. An AIS of a ship to which the occurrence of the GPS jamming is notified may be set so as not to transmit its own AIS information until the GPS jamming disappears.

Figure 3:
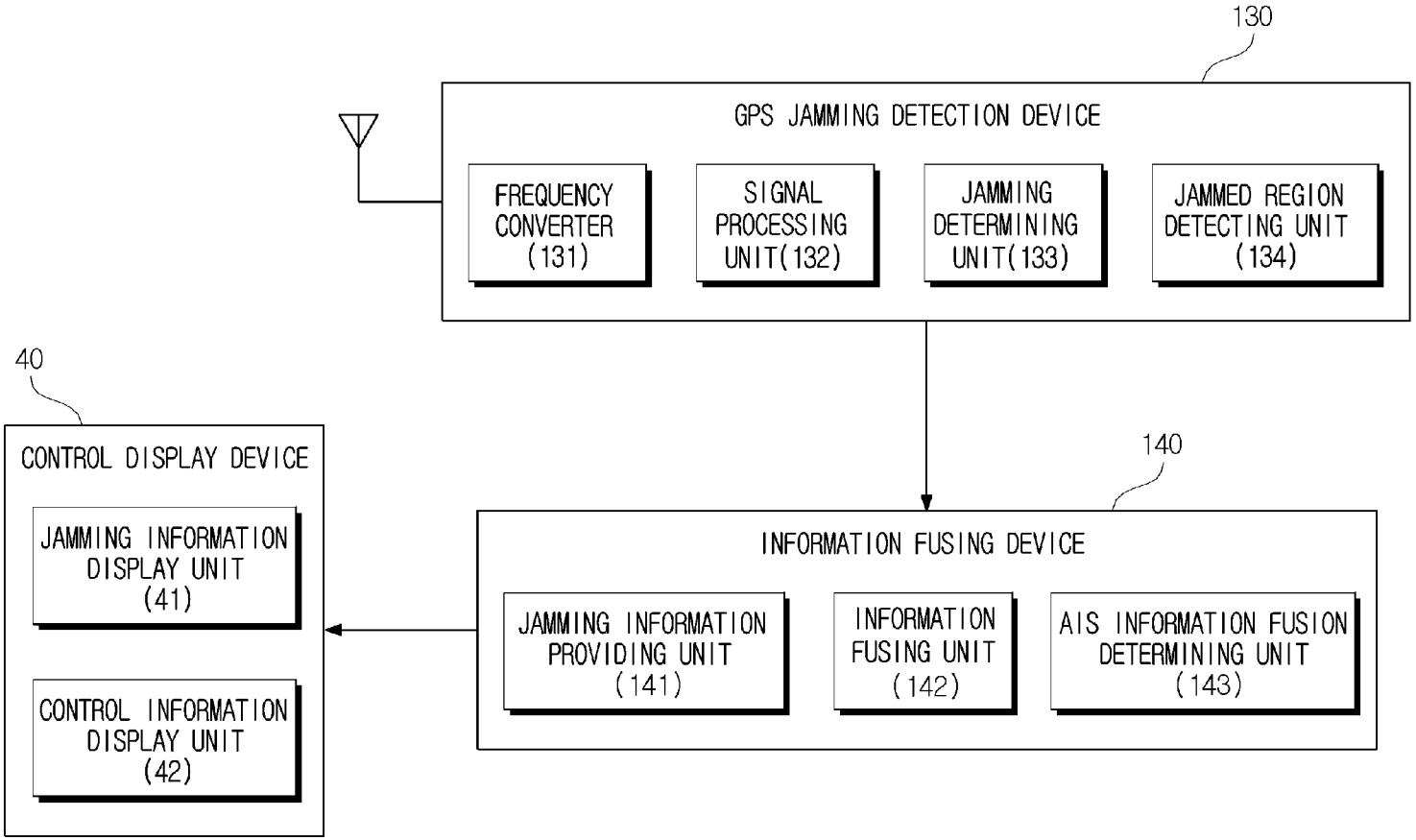
FIG. 3 is a view illustrating a more specific configuration of a GPS jamming detection device 130, an information fusing device 140, and a control display device 40 according to an exemplary embodiment of the present invention.

FIG. 3 is a view illustrating a more specific configuration of the GPS jamming detection device 130, the information fusing device 140, and the control display device 40 which have been described above.

The GPS jamming detection device 130 includes a frequency converter 131, a signal processing unit 132, a jamming determining unit 133, and a jammed region detecting unit 134.

An antenna of the GPS jamming detection device 130 receives GPS band signals, that is, L1 and L2 frequency band signals. Even though not illustrated, the GPS jamming detection device 130 may include a band pass filter which filters the L1 and L2 frequency band signals.

The frequency converter 131 converts an RF signal received through the antenna into an IF signal.

The signal processing unit 132 performs a signal processing on the IF signal from the frequency converter 131 to detect a jamming signal. For example, the signal processing unit 132 converts the IF signal into discrete data.

The jamming determining unit 133 determines whether the GPS jamming occurs from the discrete signal of the signal processing unit 132. For example, the jamming determining unit 133 measures a power spectrum density (PSD) of the L1 and L2 frequency bands from the discrete signal and compares the power spectrum density with a predetermined threshold value to determine whether the GPS jamming occurs.

If the jamming determining unit 133 determines that the GPS jamming occurs, the jammed region detecting unit 134 detects the region where the GPS jamming occurs based on the position of the GPS jamming detection device 130, a strength of a jamming signal, and an arrival of the jamming signal. The jammed region detecting unit 134 receives and combines the information collected in other GPS jamming detection devices to detect the region where the GPS jamming occurs.

The GPS jamming information such as occurrence of the GPS jamming or the region where the jamming occurs, obtained as described above, is transmitted to the information fusing device 140.

The information fusing device 140 includes an AIS information fusion determining unit 143, an information fusing unit 142, and a jamming information providing unit 141.

The AIS information fusion determining unit 143 determines whether to fuse the AIS information of the ship at the time of fusing the radar information and the AIS information based on the AIS information of the ship obtained from the AIS, the radar information of the ship obtained from the radar, and the GPS jamming information provided from the GPS jamming detection device 130.

In an exemplary embodiment, the AIS information fusion determining unit 143 compares a position of the ship which is most recently found with a region where the GPS jamming occurs. If the position of the ship is included in the region or within a predetermined distance from the region, the AIS information fusion determining unit 143 determines so as not to fuse the AIS information of the ship.

In another exemplary embodiment, if the position of the ship is included in the GPS jamming region or within a predetermined distance from the GPS jamming region, and a difference between the current position information of the AIS and the previous position information of the AIS is outside a predetermined range, the AIS information fusion determining unit 143 determines so as not to fuse the AIS information of the ship.

In still another exemplary embodiment, if the position of the ship is included in the GPS jamming region or within a predetermined distance from the GPS jamming region, and a difference between the current position information of the AIS and the position information obtained from the radar is outside a predetermined range, the AIS information fusion determining unit 143 determines so as not to fuse the AIS information of the ship.

If the position of the ship is included in the GPS jamming region or within a predetermined distance from the GPS jamming region, a difference between the current position information of the AIS and the previous position information of the AIS is outside a predetermined range, and a difference between the current position information of the AIS and the position information obtained from the radar is outside a predetermined range, the AIS information fusion determining unit 143 determines so as not to fuse the AIS information of the ship.

The information fusing unit 142 fuses the radar information of the ship obtained from the radar and the AIS information obtained from the AIS of the ship but selectively fuses the AIS information in accordance with the determination result of the AIS information fusion determining unit 143. That is, if the AIS information fusion determining unit 143 determines to fuse the AIS information of the ship, the information fusing unit 142 fuses the radar information and the AIS information of the ship to calculate the position and the speed. In contrast, if the AIS information fusion determining unit 143 determines so as not to fuse the AIS information of the ship, the information fusing unit 142 fuses only the radar information excluding the AIS information of the ship to calculate the position and the speed. The position information and the speed information of the ship which are calculated in the information fusing unit 142 are transmitted to the control display device 40.

If the jamming information providing unit 141 receives the GPS jamming information from the GPS jamming detection device 130, the jamming information providing unit 141 transmits information on whether the GPS jamming occurs and a region where the GPS jamming occurs to the control display device 40.

If the AIS information fusion determining unit 143 determines so as not to fuse AIS information of a specific ship due to the GPS jamming, the jamming information providing unit 141 notifies the control display device 40 that the AIS information of the ship is not fused.

If the jamming information providing unit 141 receives the GPS jamming information from the GPS jamming detection device 130, the jamming information providing unit 141 may transmit a message which notifies the ships located in the region where the GPS jamming occurs that the GPS jamming occurs.

The control display device 40 includes a jamming information display unit 41 and a control information display unit 42.

The control information display unit 42 displays the position information and the speed information of the ship which is received from the information fusing device 140 on a screen.

If the information fusing device 140 notifies that the GPS jamming occurs, the jamming information display unit 41 displays the occurrence of the GPS jamming and the jammed region on the screen so as to allow the controller to check the occurrence of the GPS jamming and the jammed region. The occurrence of the GPS jamming may be notified to the controller using a warning message. When the occurring GPS jamming disappears, the jamming information display unit 41 also notifies the controller through the screen or the message.

If the information fusing device 140 notifies that the AIS information of a specific ship is not fused, the jamming information display unit 41 displays that the AIS information of the ship is not used on the screen so as to allow the controller to check the fact. If the fusing method is changed to use the AIS information of the ship again, because the GPS jamming disappears, the jamming information display unit 41 also notifies the controller the fact through the screen or the message.

Figure 4:
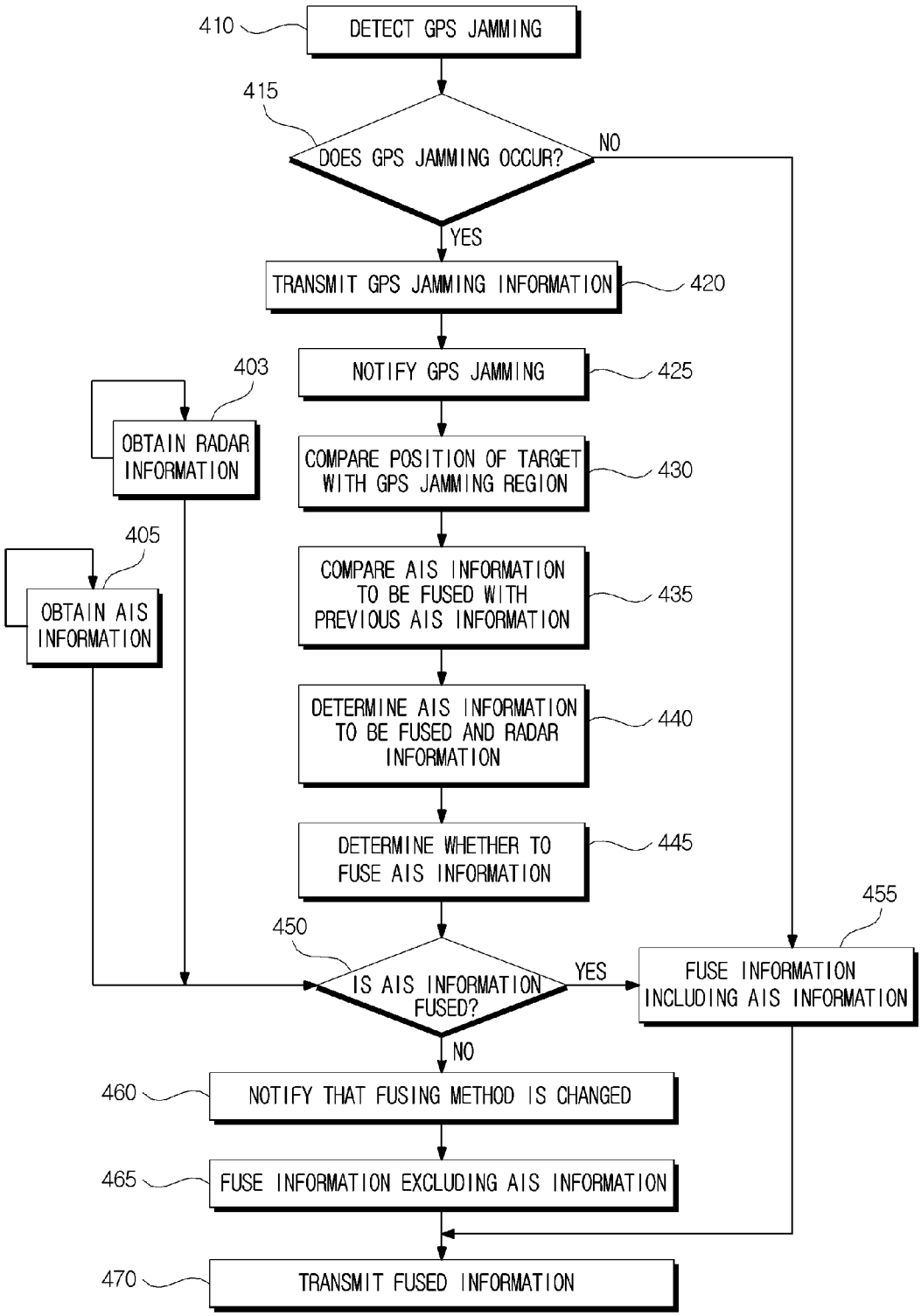
FIG. 4 is a flowchart illustrating a traffic control method according to an exemplary embodiment of the present invention.

FIG. 4 is a flowchart illustrating a traffic control method according to an exemplary embodiment of the present invention. The traffic control method according to the exemplary embodiment includes the steps which are processed in the above-described traffic control system. Therefore, even though omitted in the following description, the above-described matter with regard to the traffic control system is also applied to the traffic control method according to this exemplary embodiment.

In step 403, the information fusing device 140 obtains radar information on the ship from the radars 50.

In step 405, the information fusing device 140 obtains AIS information on the ship from the AIS.

In step 410, the GPS jamming detection device 130 detects the GPS jamming.

In step 415, if the GPS jamming does not occur as a result of the detection, the sequence proceeds to step 455 and the information fusing device 140 fuses the radar information obtained from step 403 and the AIS information obtained from step 405 to calculate the position and the speed of the ship.

In step 415, if the GPS jamming occurs as the result of the detection, the sequence proceeds to step 420 and the GPS jamming detection device 130 transmits the GPS jamming information including the position and the region where the jamming occurs to the information fusing device 140.

In step 425, the information fusing device 140 notifies the control display device 40 and the ship which is located in the region where the GPS jamming occurs that the GPS jamming occurs.

In step 430, the information fusing device 140 compares the most recently known position of the ship with the region where the GPS jamming occurs.

In step 435, the information fusing device 140 compares the AIS information to be fused, that is, the currently obtained AIS information with the previously obtained AIS information.

In step 440, the information fusing device 140 compares the AIS information to be fused, that is, the currently obtained AIS information with the position information obtained from the radar.

In step 445, the information fusing device 140 determines whether to fuse the currently obtained AIS information based on the comparison result through steps 430 to 440. For example, if the position of the ship is included in the GPS jamming region or within a predetermined distance from the GPS jamming region, the information fusing device 140 may determine so as not to fuse the AIS information. Alternatively, if the position of the ship is included in the GPS jamming region or within a predetermined distance from the GPS jamming region and a difference between the current position information of the AIS and the previous position information of the AIS is outside a predetermined range, the information fusing device 140 may determine so as not to fuse the AIS information. Alternatively, if the position of the ship is included in the GPS jamming region or within a predetermined distance from the GPS jamming region and a difference between the current position information of the AIS and the position information obtained from the radar is outside a predetermined range, the information fusing device 140 may determine so as not to fuse the AIS information. If the position of the ship is included in the GPS jamming region or within a predetermined distance from the GPS jamming region, a difference between the current position information of the AIS and the previous position information of the AIS is outside a predetermined range, and a difference between the current position information of the AIS and the position information obtained from the radar is outside a predetermined range, it is determined that the AIS information of the ship is not fused.

In step 450, if it is determined to fuse the AIS information as a result of the determination, the sequence proceeds to step 455 and the information fusing device 140 fuses the radar information obtained from step 403 and the AIS information obtained from step 405 to calculate the position and the speed of the ship.

In step 450, if it is determined so as not to fuse the AIS information as a result of the determination, the sequence proceeds to step 460 and the information fusing device 140 notifies the control display device 40 that the fusing method is changed. The control display device 40 which is notified displays that the AIS information is not fused so as to allow the controller to check that.

In step 465, the information fusing device 140 fuses only the radar information obtained from step 403 excluding the AIS information obtained from step 405 to calculate the position and the speed of the ship.

In step 470, the information fusing device 140 transmits the position and speed information of the ship which is fused information calculated through step 455 or step 465 to the control display device 40.

The above-described exemplary embodiments of the present invention may be created by a computer executable program and implemented in a general use digital computer which operates the program using a computer readable medium. The computer readable recording medium includes a storage medium such as a magnetic storage medium (for example, ROM, floppy disk, hard disk) and an optical reading medium (for example, a CD-ROM or a DVD).

As described above, the exemplary embodiments have been described and illustrated in the drawings and the specification. The exemplary embodiments were chosen and described in order to explain certain principles of the invention and their practical application, to thereby enable others skilled in the art to make and utilize various exemplary embodiments of the present invention, as well as various alternatives and modifications thereof. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A traffic control method, comprising:

obtaining radar information on a target from at least one radar, obtaining automatic identification system (AIS) information of the target from an AIS of the target;

detecting GPS jamming; and fusing the radar information and the AIS information, wherein, in response to the detection of the GPS jamming, the fusing selectively fuses the AIS information depending on whether the GPS jamming occurs in the position of the target.

2. The traffic control method of claim 1, wherein the AIS information includes position information of the target.

3. The traffic control method of claim 1, wherein the fusing compares the already known position of the target with a region where the GPS jamming occurs to selectively fuse the AIS information.

4. The traffic control method of claim 1, wherein the fusing compares the already known position of the target with a region where the GPS jamming occurs and compares the AIS information with previously obtained AIS information to selectively fuse the AIS information.

5. The traffic control method of claim 1, wherein the fusing compares the already known position of the target with a region where the GPS jamming occurs and compares the AIS information with the radar information to selectively fuse the AIS information.

6. The traffic control method of claim 1, wherein if the GPS jamming occurs in the position of the target, the AIS information is not fused during the fusing.

7. The traffic control method of claim 1, further comprising:

displaying that the AIS information is not fused if the AIS information is not fused.

8. The traffic control method of claim 1, further comprising:

notifying the target of the GPS jamming if the GPS jamming occurs in the position of the target.

9. A traffic control system, comprising:

a GPS jamming detection device which detects GPS jamming, and an information fusing device which obtains radar information on a target from at least one radar, obtains automatic identification system (AIS) information of the target from an AIS of the target, and fuses the radar information and the AIS information, wherein, in response to the GPS jamming detection device detecting the GPS jamming, the information fusing device selectively fuses the AIS information depending on whether the GPS jamming occurs in the position of the target.

10. The traffic control system of claim 9, wherein the AIS information includes position information of the target.

11. The traffic control system of claim 9, wherein the information fusing device compares the already known position of the target with a region where the GPS jamming occurs to selectively fuse the AIS information.

12. The traffic control system of claim 9, wherein the information fusing device compares the already known position of the target with a region where the GPS jamming occurs and compares the AIS information with previously obtained AIS information to selectively fuse the AIS information.

13. The traffic control system of claim 9, wherein the information fusing device compares the already known position of the target with a region where the GPS jamming occurs and compares the AIS information with the radar information to selectively fuse the AIS information.

14. The traffic control system of claim 9, wherein if the GPS jamming occurs in the position of the target, the information fusing device does not fuse the AIS information.

15. The traffic control system of claim 9, wherein if the AIS information is not fused, the information fusing device notifies that the AIS information is not fused to a control display device which displays a traffic control condition.

16. The traffic control system of claim 9, wherein when the GPS jamming occurs in the position of the target, the information fusing device notifies the target of the GPS jamming.

* * * * *